US009416788B2

(12) United States Patent
Oda et al.

(10) Patent No.: US 9,416,788 B2
(45) Date of Patent: Aug. 16, 2016

(54) TURBO COMPRESSOR AND REFRIGERATOR

(75) Inventors: Kentarou Oda, Yokohama (JP); Minoru Tsukamoto, Yokohama (JP)

(73) Assignee: DAIKIN INDUSTRIES, LTD. (JP)

( * ) Notice: Subject to any disclaimer, the term of this patent is extended or adjusted under 35 U.S.C. 154(b) by 383 days.

(21) Appl. No.: 12/838,054

(22) Filed: Jul. 16, 2010

(65) Prior Publication Data

US 2011/0016914 A1 Jan. 27, 2011

(30) Foreign Application Priority Data

Jul. 21, 2009 (JP) ..... P2009-170193

(51) Int. Cl.

| | |
|---|---|
| ***F25B 43/02*** | (2006.01) |
| ***F04D 25/02*** | (2006.01) |
| ***F04D 17/12*** | (2006.01) |
| ***F04D 29/063*** | (2006.01) |
| ***F04D 29/58*** | (2006.01) |

(52) U.S. Cl.

CPC ..... *F04D 25/02* (2013.01); *F04D 17/12* (2013.01); *F04D 29/063* (2013.01); *F04D 29/584* (2013.01); *F04D 29/5826* (2013.01)

(58) Field of Classification Search

CPC ..... F04D 25/02; F04D 17/12; F04D 29/5826; F04D 29/584; F04D 29/063

USPC ..... 62/84, 498, 468, 469, 470, 472, 473, 62/510; 415/159; 417/244, 423.1, 423.5, 417/423.8, 423.13

See application file for complete search history.

(56) References Cited

U.S. PATENT DOCUMENTS

| | | | | |
|---|---|---|---|---|
| 3,508,416 | A * | 4/1970 | Miller | F04D 27/0246 62/193 |
| 3,853,433 | A * | 12/1974 | Roberts et al. | 417/423.13 |
| 4,404,812 | A * | 9/1983 | Zinsmeyer | 62/84 |
| 5,211,031 | A * | 5/1993 | Murayama et al. | 62/498 |
| 5,823,294 | A * | 10/1998 | Mizutani et al. | 184/6.3 |
| 6,018,962 | A * | 2/2000 | Dewhirst et al. | 62/468 |
| 2007/0147985 | A1 * | 6/2007 | Takahashi | F04D 17/12 415/104 |
| 2007/0234997 | A1 * | 10/2007 | Prenger | 123/196 S |

FOREIGN PATENT DOCUMENTS

| | | | |
|---|---|---|---|
| JP | 07218010 | A * | 8/1995 |
| JP | 3489631 | | 1/2004 |

OTHER PUBLICATIONS

JP 07218010 A translation.*

* cited by examiner

*Primary Examiner* — Marc Norman
*Assistant Examiner* — Jon T Schermerhorn
(74) *Attorney, Agent, or Firm* — Ostrolenk Faber LLP

(57) ABSTRACT

A turbo compressor includes a case; compression stages which are disposed in a plural number in a rotatable manner with respect to the case via a sliding part; an oil tank in which a lubricant oil to be supplied to the sliding part is stored; a pressure equalization pipe which communicates the oil tank with the vicinity of the inlet of the compression stage; and a check valve which allows only the movement of the fluid from the oil tank side to the compression stage side in the pressure equalization pipe.

6 Claims, 3 Drawing Sheets

TURBO COMPRESSOR AND REFRIGERATOR

BACKGROUND OF THE INVENTION

1. Field of the Invention

The present invention relates to a turbo compressor and a refrigerator. More specifically, the present invention relates to a turbo compressor capable of compressing a fluid by a plurality of impellers and a refrigerator including the turbo compressor.

Priority is claimed on Japanese Patent Application No. 2009-170193, filed Jul. 21, 2009, the content of which is incorporated herein by reference.

2. Description of Related Art

There is known a turbo refrigerator or the like including a turbo compressor which compresses and discharges the refrigerant by means of a compressing means equipped with an impeller or the like as a refrigerator for cooling or refrigerating a material to be cooled such as water.

In the compressor, if the compression ratio increases, the discharging temperature of the compressor rises and the volumetric efficiency declines. Thus, in the turbo compressor included in the turbo refrigerator or the like as described above, the compression of the refrigerant is often performed so as to be divided into a plurality of stages.

In such a turbo compressor, the lubricant oil is supplied to sliding parts such as a bearing from an oil tank. Furthermore, in order to release the refrigerant gas, which is generated in the oil tank when the compressor starts, to the inlet side of the compressor, a pressure equalization pipe for making the oil tank and the compressor communicate with each other is disposed (for example, see Japanese Patent No. 3489631).

The turbo compressor essentially continues to operate over a long time at a constant rotation speed. However, for the purpose of energy saving, the operation ON/OFF is frequently performed. At this time, in the case where only the pressure equalization pipe is disposed, when the compressor is stopped, the refrigerant flows backward from a condenser into the compressor inlet, so that the pressure of the compressor inlet increases, whereby the refrigerant flows backward from the pressure equalization pipe into the oil tank side. There is a problem that the refrigerant flows backward to the oil tank and leaks from a labyrinth seal into a compressor flow path or a motor, and, at this time, the lubricant oil, which is being refueled to the bearing near the labyrinth, is also taken out as oil leakage, whereby the amount of oil in the oil tank is reduced.

SUMMARY OF THE INVENTION

The present invention provides a turbo compressor and a refrigerator which can suitably suppress the back flow of the refrigerant through the pressure equalization pipe to the oil tank side by means of a simple configuration.

According to a first aspect of the present invention, a turbo compressor relating to the present invention includes a case, a plurality of compression stages which are disposed in a rotatable manner with respect to the case via a sliding part, an oil tank in which lubricant oil to be supplied to the sliding parts is stored, a pressure equalization pipe which connects the oil tank with the vicinity of the inlet of the compression stages, and a check valve which allows only the movement of the fluid from the oil tank side to the compression stage side in the pressure equalization pipe.

The turbo compressor has the check valve. For this reason, when the pressure of the compressor inlet side becomes higher than that of the oil tank side during operation stop, the check valve can be closed to block the pressure equalization pipe.

According to a second aspect of the present invention, the turbo compressor relating to the present invention includes a suction capacity adjusting portion disposed in the inlet of the compression stage, and an end of the pressure equalization pipe is opened to and is disposed in a relay space provided on the case so as to communicate with the rear surface of the suction capacity adjusting portion.

In the turbo compressor, the relay space, which communicates with the rear surface of the suction capacity adjusting portion reaching the lowest pressure during operation, also reaches the low pressure. For this reason, the inside of the oil tank can also be made to have low pressure through the pressure equalization pipe, whereby the lubricant oil can be suitably collected by the oil tank.

According to a third aspect of the present invention, the turbo compressor relating to the present invention has the check valve built into the case.

In the turbo compressor, since the check valve does not protrude outside the case, it is possible to secure the airtightness of the overall case and promote the space saving of the overall compressor.

According to a fourth aspect of the present invention, a refrigerator relating to the present invention includes a condenser that cools and liquefies the compressed refrigerant, an evaporator which cools a material to be cooled by evaporating the liquefied refrigerant to take the vaporization heat from the material to be cooled, and a turbo compressor which compresses the refrigerant evaporated by the evaporator to supply the same to the condenser, wherein the above-mentioned turbo compressor is used as the turbo compressor.

The refrigerator exhibits the same working effects as the turbo compressor.

According to the present invention, it is possible to suitably suppress the back flow of the refrigerant through the pressure equalization pipe to the oil tank side by means of a simple configuration.

DETAILED DESCRIPTION OF THE INVENTION

Figure 1:
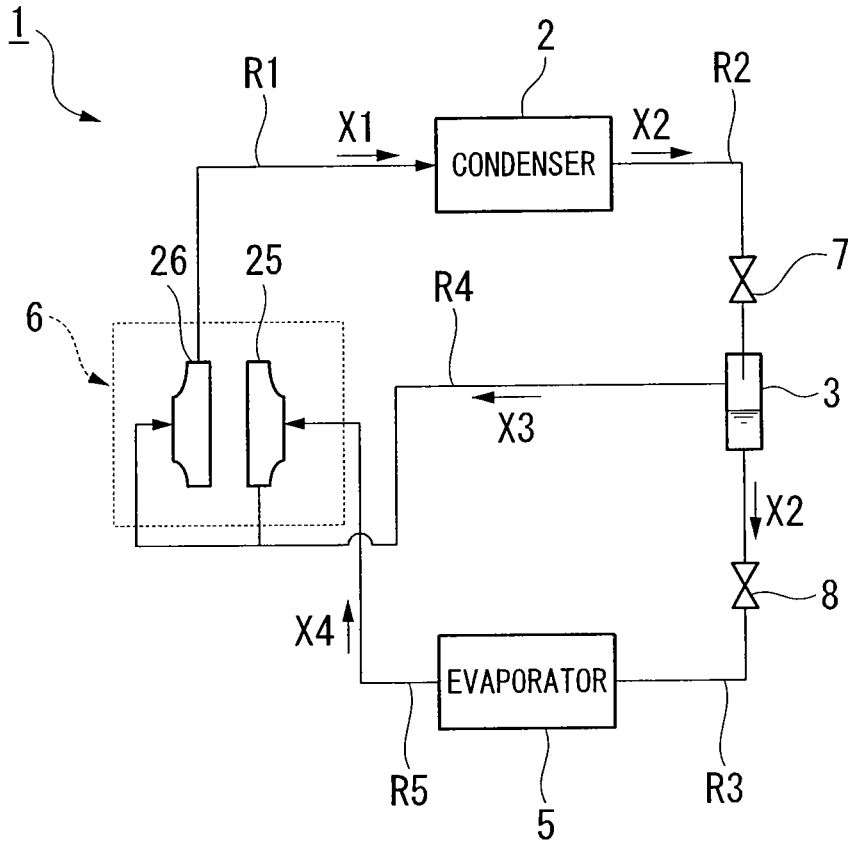
FIG. 1 is a block diagram showing a schematic configuration of a turbo refrigerator relating to an embodiment of the present invention.

An embodiment of a turbo compressor and a refrigerator relating to the present invention will be described with reference to FIGS. 1 and 2.

A turbo refrigerator (a refrigerator) 1 relating to the present embodiment is, for example, installed on a building or a factory so as to create the cooling water for air conditioning. As shown in FIG. 1, the turbo refrigerator 1 includes a condenser 2, an economizer 3, an evaporator 5 and a turbo compressor 6.

The condenser 2 is supplied with a compressed refrigerant gas X1, which is a refrigerant (a fluid) compressed in a gas state, and makes the compressed refrigerant gas X1 a refrigerant liquid X2 by cooling and liquefying the compressed refrigerant gas X1. As shown in FIG. 1, the condenser 2 is connected to the turbo compressor 6 via a flow path R1 through which the compressed refrigerant gas X1 flows and is connected to the economizer 3 via a flow path R2 through which the refrigerant liquid X2 flows. An expansion valve 7 for decompressing the refrigerant liquid X2 is installed in the flow path R2.

The economizer 3 temporarily stores the refrigerant liquid X2 which has been decompressed in the expansion valve 7. The economizer 3 is connected to the evaporator 5 via a flow path R3 through which the refrigerant liquid X2 flows. Furthermore, the economizer 3 is connected to the turbo compressor 6 via a flow path R4 through which gaseous components X3 of the refrigerant generated in the economizer 3 flow. An expansion valve 8 for further decompressing the refrigerant liquid X2 is installed in the flow path R3. The flow path R4 is connected to the turbo compressor 6 so as to supply the gaseous components X3 to a second compression stage 26 described below which is included in the turbo compressor 6.

The evaporator 5 cools the material to be cooled by evaporating the refrigerant liquid X2 to take the vaporization heat from the material to be cooled such as water. The evaporator 5 is connected to the turbo compressor 6 via a flow path R5 through which a refrigerant gas X4 generated by the evaporation of the refrigerant liquid X2 flows. The flow path R5 is connected to a first compression stage 25 described below which is included in the turbo compressor 6.

The turbo compressor 6 compresses the refrigerant gas X4 to produce the compressed refrigerant gas X1. As described above, the turbo compressor 6 is connected to the condenser 2 via the flow path R1 through which the compressed refrigerant gas X1 flows. Furthermore, the turbo compressor 6 is connected to the evaporator 5 via the flow path R5 through which the refrigerant gas X4 flows.

Figure 2:
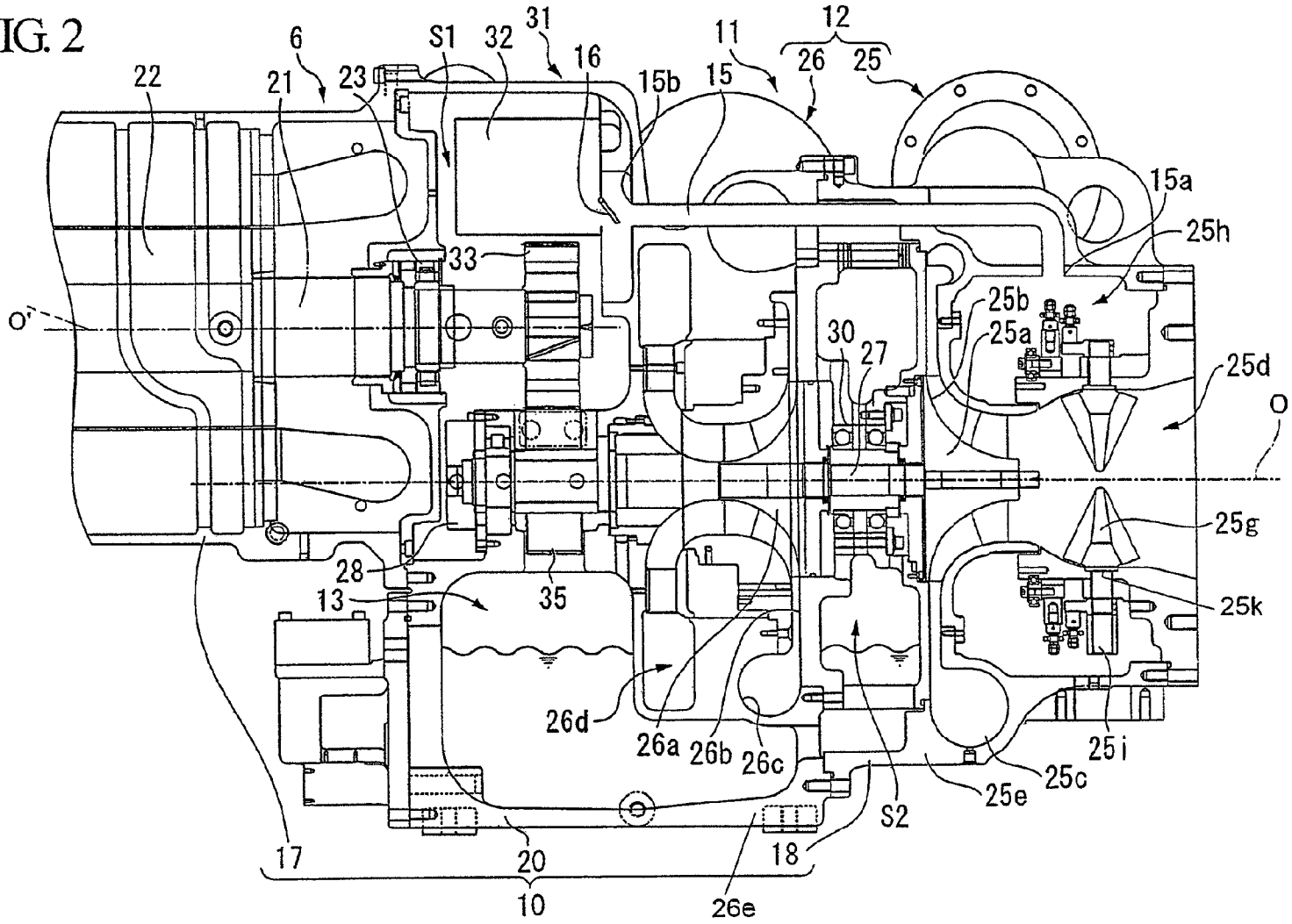
FIG. 2 is a vertical sectional view of a turbo compressor included in the turbo refrigerator relating to an embodiment of the present invention.

As shown in FIG. 2, the turbo compressor 6 includes a case 10, a plurality of compression stages 12 which are disposed rotatably with respect to the case 10 via a sliding part 11, an oil tank 13 in which the lubricant oil to be supplied to the sliding part 11 is stored, a pressure equalization pipe 15 which connects the oil tank 13 with the vicinity of the inlet of the compression stages 12, and a check valve 16 which allows only the movement of the fluid from the oil tank 13 side to the compression stages 12 side in the pressure equalization pipe 15.

The case 10 is divided into a motor housing 17, a compressor housing 18 and a gear housing 20, and those parts are connected to each other in a separable manner. In the motor housing 17, an output shaft 21 which rotates around an axis O', and a motor 22, which is connected to the output shaft 21 and drives the compression stages 12, are disposed. The output shaft 21 is rotatably supported by a first bearing 23 fixed to the motor housing 17. Herein, the sliding part 11 includes not only the first bearing 23 but a second bearing 28, a third bearing 30, a gear unit 31 or the like described below.

The compression stages 12 include a first compression stage 25 which sucks and compresses the refrigerant gas X4 (see FIG. 1), and a second compression stage 26 which further compresses the refrigerant gas X4 compressed in the first compression stage 25 to discharge the refrigerant gas X4 as the compressed refrigerant gas X1 (see FIG. 1). The first compression stage 25 is disposed on the compressor housing 18 and the second compression stage 26 is disposed on the gear housing 20.

The first compression stage 25 has a plurality of first impellers 25*a*, a first diffuser 25*b*, a first scroll chamber 25*c* and a suction port 25*d*. The plurality of first impellers 25*a* is fixed to a rotational shaft 27, which is driven for rotation around the axis O by means of the motor 22, and imparts speed energy to the refrigerant gas X4 which is supplied from a thrust direction to discharge the refrigerant gas X4 in a radial direction. The first diffuser 25*b* compresses the refrigerant gas X4 by converting the speed energy imparted to the refrigerant gas X4 by the first impeller 25*a* into pressure energy. The first scroll chamber 25*c* leads the refrigerant gas X4 compressed by the first diffuser 25*b* to the outside of the first compression stage 25. The suction port 25*d* sucks the refrigerant gas X4 to supply the same to the first impeller 25*a*. The first diffuser 25*b*, the first scroll chamber 25*c* and a part of the suction port 25*d* is formed by a first housing 25*e* surrounding the first impeller 25*a*.

A plurality of inlet guide vanes (suction capacity adjusting portions) 25*g* for adjusting the suction capacity of the first compression stage 25 is installed in the suction port 25*d* of the first compression stage 25. The respective inlet guide vanes 25*g* can rotate so that apparent areas from the flow direction of the refrigerant gas X4 can be altered by means of a driving mechanism 25*i*.

A relay space 25*h*, which forms a ring shape centered on the axis O, is dividedly formed in the first housing 25*e*, which is the outer peripheral portion of the first impeller 25*a* in the first compression stage 25, and the suction port 25*d* at the upstream side of the first impeller 25*a*. An end 15*a* of the pressure equalization pipe 15 is connected to the relay space 25*h*, and the driving mechanism 25*i* for driving the inlet guide vanes 25*g* is housed inside the relay space 25*h*.

The relay space 25*h* communicates with the rear surface side of the inlet guide vanes 25*g* in the suction port 25*d* via a slight gap 25*k*. As a result, it is configured such that the pressure of the relay space 25*h* is always equal to that of the suction port 25*d*. The relay space 25*h* is connected to an accommodation space S1 described below by means of the pressure equalization pipe 15.

The second compression stage 26 includes a second impeller 26*a*, a second diffuser 26*b*, a second scroll chamber 26*c* and an inlet scroll chamber 26*d*. The second impeller 26*a* imparts speed energy to the refrigerant gas X4, which is compressed in the first compression stage 25 and is supplied from the thrust direction, to discharge the refrigerant gas X4 in the radial direction. The second diffuser 26*b* compresses the refrigerant gas X4 by converting the speed energy imparted to the refrigerant gas X4 by the second impeller 26*a* to the pressure energy to discharge the refrigerant gas X4 as the compressed refrigerant gas X1. The second scroll chamber 26*c* leads the compressed refrigerant gas X1 discharged from the second diffuser 26*b* to the outside of the second compression stage 26. The inlet scroll chamber 26*d* guides the refrigerant gas X4 compressed in the first compression stage 25 to the second impeller 26*a*. The second diffuser 26*b*, the second scroll chamber 26*c* and a part of the inlet scroll chamber 26*d* are formed by a second housing 26*e* surrounding the second impeller 26*a*.

The second impeller 26*a* is fixed to the rotational shaft 27 such that the rear surface thereof is mated with that of the first impeller 25*a*, and the rotational movement force from the output shaft 21 of the motor 22 is transmitted to the rotational shaft 27, so that the rotational shaft 27 rotates around the axis O, whereby the second impeller 26*a* is driven for rotation. The second diffuser 26*b* is annularly disposed around the second impeller 26*a*.

The second scroll chamber 26*c* is connected to the flow path R1 for supplying the condenser 2 with the compressed refrigerant gas X1 to supply the flow path R1 with the compressed refrigerant gas X1 led from the second compression stage 26.

In addition, the first scroll chamber 25*c* of the first compression stage 25 and the inlet scroll chamber 26*d* of the second compression stage 26 are connected with each other via an outside piping (not shown) which is provided separately from the first compression stage 25 and the second compression stage 26, whereby the refrigerant gas X4 compressed in the first compression stage 25 is supplied to the second compression stage 26 via the outside piping. The above-mentioned flow path R4 (see FIG. 1) is connected to the outside piping, whereby the gaseous components X3 of the refrigerant generated in the economizer 3 is supplied to the second compression stage 26 via the outside piping.

The rotational shaft 27 is rotatably supported by the second bearing 28 fixed to the gear housing 20 and by the third bearing 30 fixed to the compressor housing 18.

In the gear housing 20, an accommodation space S1 is formed which accommodates a gear unit 31 for transmitting the driving force of the output shaft 21 to the rotational shaft 27 and a demister 32 for preventing the mixing of the oil mist. The oil tank 13 is disposed under the accommodation space S1. The oil tank 13 also communicates with a space S2 formed inside the compressor housing 18. The check valve 16 is disposed in the demister 32 and is connected to the other end 15*b* of the pressure equalization pipe 15. In addition, the check valve 16 does not necessarily need to be disposed in the demister 32 and may be connected to the pressure equalization pipe 15.

The gear unit 31 includes a low speed gear 33 fixed to the output shaft 21 of the motor 22 and a high speed gear 35 which is fixed to the rotational shaft 27 and is engaged with the low speed gear 33. In addition, the rotational movement force of the output shaft 21 of the motor 22 is transmitted to the rotational shaft 27 such that the rotational speed of the rotational shaft 27 is greater than the rotational speed of the output shaft 21.

Next, the operation of the turbo refrigerator 1 and the turbo compressor 6 relating to the present embodiment will be described.

First of all, along with the operation start of the turbo refrigerator 1 and the turbo compressor 6, the lubricant oil is supplied from the oil tank 13 to the sliding part 11 by means of an oil pump (not shown). Then, the motor 22 is driven, so that the rotational movement force of the output shaft 21 of the motor 22 is transmitted to the rotation shaft 27 via the gear unit 31, whereby the first compression stage 25 and the second compression stage 26 are driven for rotation.

When the first compression stage 25 is driven for rotation, the suction port 25*d* of the first compression stage 25 enters a negative pressure state, whereby the refrigerant gas X4 from the flow path R5 flows in the first compression stage 25 via the suction port 25*d*. At this time, the suction capacity is suitably adjusted by means of the inlet guide vanes 25*g*.

The refrigerant gas X4 that flowed into the first compression stage 25 flows in the first impeller 25*a* from the thrust direction, is imparted with the speed energy by the first impeller 25*a* and is discharged in the radial direction.

When the first impeller 25*a* is driven for rotation and the suction port 25*d* enters the negative pressure state, the inside of the relay space 25*h* communicating with the gap 25*k* also enters the negative pressure state. For this reason, since the pressure of the accommodation space S1 side becomes higher than that of the relay space 25*h* side, the check valve 16 enters an open state, whereby the suction port 25*d* situated at the upstream side of the first impeller 25*a* enters a state of communicating with the oil tank 13 via the gap 25*k*, the relay space 25*h*, the pressure equalization pipe 15, the check valve 16, and the accommodation space S1. In addition, the pressure of the suction port 25*d* becomes substantially the same as that of the inside of the oil tank 13, and the inside of the oil tank 13 also enters the negative pressure state. For this reason, the lubricant oil, which has flowed down from the sliding parts 11 which are supplied with the lubricant oil such as the first bearing 23, the second bearing 28, the third bearing 30, and the gear unit 31, moves toward the oil tank 13 which has entered the negative pressure state and is collected.

The refrigerant gas X4 discharged from the first impeller 25*a* is compressed by converting the speed energy to the pressure energy by means of the first diffuser 25*b*. The refrigerant gas X4 discharged from the first diffuser 25*b* is led to the outside of the first compression stage 25 via the first scroll chamber 25*c*.

In addition, the refrigerant gas X4 led to the outside of the first compression stage 25 is supplied to the second compression stage 26 via the outside piping.

The refrigerant gas X4 supplied to the second compression stage 26 flows into the second impeller 26*a* from the thrust direction via the inlet scroll chamber 26*d* and is discharged in the radial direction imparted with the speed energy by the second impeller 26*a*.

The speed energy of the refrigerant gas X4 discharged from the second impeller 26*a* is converted to the pressure energy by the second diffuser 26*b*, whereby the refrigerant gas X4 is further compressed and becomes the compressed refrigerant gas X1.

The compressed refrigerant gas X1 discharged from the second diffuser 26*b* is led to the outside of the second compression stage 26 via the second scroll chamber 26*c*.

In addition, the compressed refrigerant gas X1 led to the outside of the second compression stage 26 is supplied to the condenser 2 via the flow path R1.

On the other hand, when the turbo refrigerator 1 is stopped due to energy saving measures or the like, the refrigerant flows backward from the condenser 2 to the inlet of the turbo compressor 6, whereby the pressure of the suction port 25*d* increases. At this time, since the pressure in the relay space 25*h* becomes higher than that of the accommodation space S1, the back flow of the refrigerant is generated to the pressure equalization pipe 15 side, but the check valve 16 is closed. In this way, even when the pressure of the relay space 25*h* side increases, the pressure in the oil tank 13 (the accommodation space S1) is maintained, since the back flow of the refrigerant to the oil tank 13 side is blocked.

In the turbo refrigerator 1 and the turbo compressor 6, since the check valve 16 is disposed in the turbo compressor 6, when the pressure of the inlet side of the turbo compressor 6 becomes higher than that of the oil tank 13 (the accommodation space S1) side during operation stop, the check valve 16 can be closed to block the pressure equalization pipe 15. Thus, it is possible to suitably suppress the back flow of the refrigerant to the oil tank 13 (the accommodation space S1) side through the pressure equalization pipe 15 even with a simple configuration, which can suitably suppress the leakage of the lubricant oil due to the leakage of the refrigerant from the oil tank 13 (the accommodation space S1) to the motor 22 or the like.

In particular, the one end 15*a* of the pressure equalization pipe 15 opens to the relay space 25*h* provided so as to communicate with the rear surface of the inlet guide vane 25*g*. Thus, during operation, it is possible to make the pressure in the oil tank 13 (the accommodation space S1) the same as in the relay space 25*h* with negative pressure to allow the oil tank 13 to suitably collect the lubricant oil.

In addition, since the check valve 16 is built in the case 10, it is possible to promote the space saving of the overall turbo compressor 6 while securing the air-tightness without the check valve 16 being protruded outside the case 10.

Furthermore, the technical scope of the present invention is not limited to the above-mentioned embodiment, and various modifications can be added without departing from the gist of the present invention.

Figure 3:
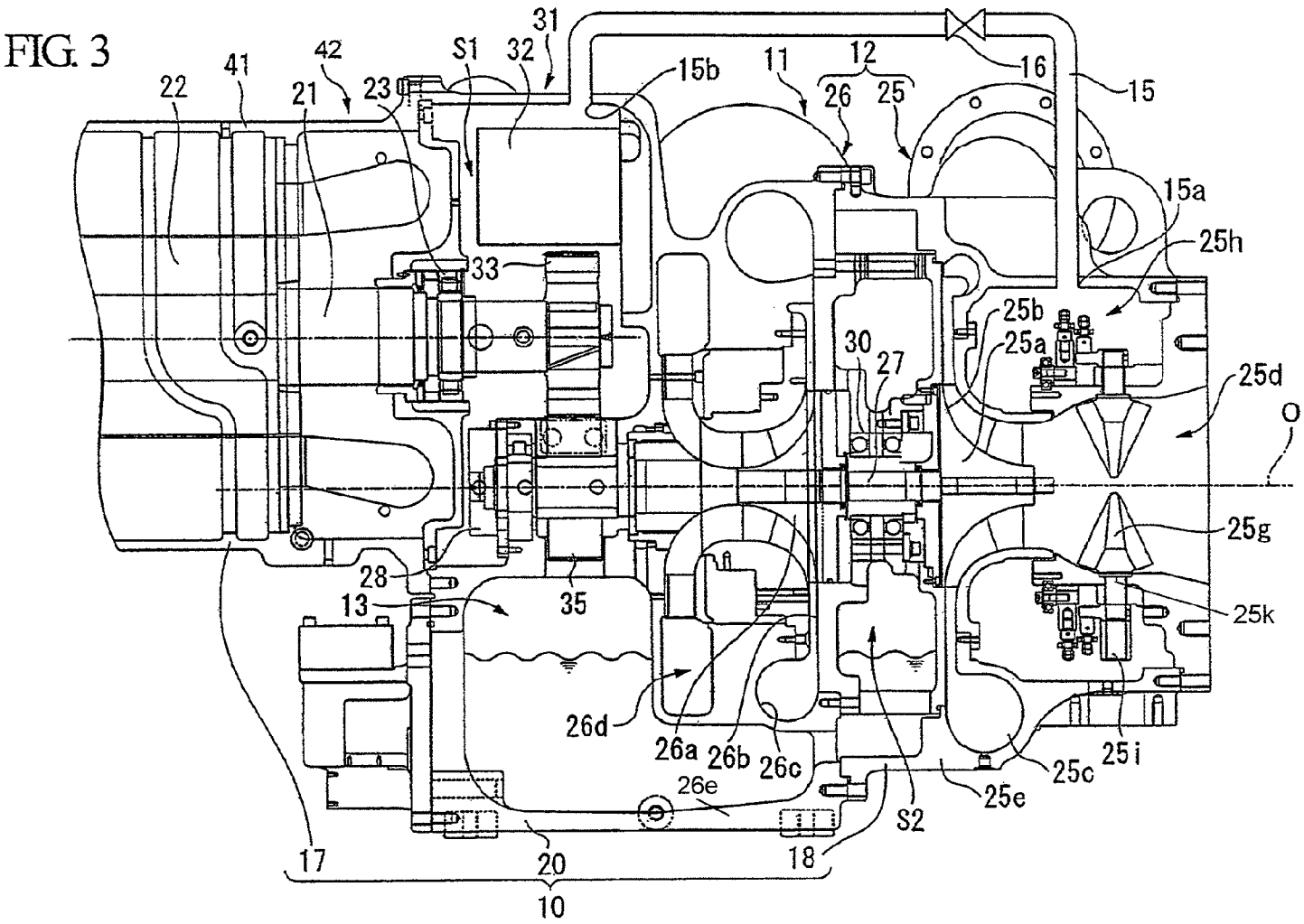
FIG. 3 is a vertical sectional view of a turbo compressor included in the turbo refrigerator relating to another embodiment of the present invention.

For example, in the above-mentioned embodiments, although it has been described that the check valve 16 is built into the case 10, the present invention is not limited thereto, and, as shown in FIG. 3, the present invention may be a turbo compressor 42 and a turbo refrigerator 1 in which a pressure equalization pipe 15 is disposed at the outside of the case 10, the oil tank 13 (the accommodation space S1) communicates with the relay space 25*h*, and the check valve 16 is disposed in the middle of the pressure equalization pipe 15.

Furthermore, in the above-mentioned embodiments, although the configuration including the two compression stages (the first compression stage 25 and the second compression stage 26) has been described, the present invention is not limited thereto, but a configuration including one or three or more compression stages may be adopted.

In addition, although, a case 10, of the turbo compressor, in which the motor housing 17, the compressor housing 18, and the gear housing 20 are each dividedly formed, has been described, the present invention is not limited thereto, and, for example, a configuration, in which the motor is disposed between the first compression stage and the second compression stage, may be adopted.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A turbo compressor comprising:

a case;

a plurality of compression stages which are disposed in a rotatable manner with respect to the case via sliding parts;

an oil tank in which lubricant oil to be supplied to the sliding parts is stored;

a pressure equalization pipe which connects the oil tank with a vicinity of an inlet of a compression stage of the plurality of compression stages via a relay space which is defined by an outer circumferential surface of a first housing of the case and an inner circumferential surface of the first housing of the case and forms a hollow ring shape centered on an axis of the plurality of compression stages;

a check valve connected to the pressure equalization pipe to allow only the movement of a fluid from an oil tank side to a compression stage side in the pressure equalization pipe; and a suction capacity adjusting portion which is disposed inside of the case and at the inlet of the compression stage, wherein a first end of the pressure equalization pipe opens into an outer circumferential surface of the hollow ring shaped relay space so as to communicate with a rear surface of the suction capacity adjusting portion, the relay space communicating with the rear surface of the suction capacity adjusting portion, a second end of the pressure equalization pipe opens into an accommodation space, the accommodation space at least containing one of the sliding parts, the check valve is connected to the second end of the pressure equalization pipe, the second end of the pressure equalization pipe is configured to open in a horizontal direction, the check valve is a swing check valve, the swing check valve having an upper end which is a fulcrum point about which the swing check valve swings, and the check valve closes by pressure in the inlet of the compression stage which becomes higher than pressure in the accommodation space when the turbo compressor stops operation.

2. The turbo compressor according to claim 1, wherein the check valve is built in the case.

3. A refrigerator comprising:

a condenser that cools and liquefies a compressed refrigerant;

an evaporator which cools a material to be cooled by evaporating a liquefied refrigerant to take a vaporization heat from the material to be cooled; and a turbo compressor which compresses the refrigerant evaporated by the evaporator to supply the refrigerant to the condenser, wherein the turbo compressor according to claim 1 is used as the turbo compressor.

4. A refrigerator comprising:

a condenser that cools and liquefies a compressed refrigerant;

an evaporator which cools a material to be cooled by evaporating a liquefied refrigerant to take a vaporization heat from the material to be cooled; and a turbo compressor which compresses the refrigerant evaporated by the evaporator to supply the refrigerant to the condenser, wherein the turbo compressor according to claim 2 is used as the turbo compressor.

5. The turbo compressor according to claim 1, wherein the compression stage further comprises a compressor impeller connected to a rotary shaft and capable of rotating around an axial line thereof, and a diffuser around the compressor impeller.

6. The turbo compressor according to claim 2, wherein the compression stage further comprises a compressor impeller connected to a rotary shaft and capable of rotating around an axial line thereof, and a diffuser around the compressor impeller.

* * * * *